US005421646A

United States Patent [19]

McNamara et al.

[11] Patent Number: 5,421,646

[45] Date of Patent: Jun. 6, 1995

[54] LEGLESS LOCKER SHELF ASSEMBLY

[75] Inventors: George E. McNamara; Craig N. Hansen, both of Minnetonka, Minn.

[73] Assignee: Minnesota American, Inc., Minnetonka, Minn.

[21] Appl. No.: 89,188

[22] Filed: Jul. 12, 1993

[51] Int. Cl.[6] ..... A47B 45/00

[52] U.S. Cl. ..... 312/205; 108/137; 108/102; 211/153

[58] Field of Search ..... 312/205, 408, 410, 242, 312/351; 108/137, 143, 102; 211/153, 134; 248/235, 243; 74/527

[56] References Cited

U.S. PATENT DOCUMENTS

| | | | |
|---|---|---|---|
| 7,789 | 11/1850 | Shoenberger . | |
| D. 329,157 | 9/1992 | Santucci . | |
| 332,238 | 12/1885 | Denton . | |
| 584,082 | 6/1897 | Nessle . | |
| 739,085 | 9/1903 | Kamerer . | |
| 905,737 | 12/1908 | McCombe . | |
| 940,023 | 11/1909 | Hutchinson . | |
| 1,043,950 | 11/1912 | Martin | 108/137 |
| 1,069,411 | 8/1913 | Greene | 312/242 |
| 1,167,550 | 1/1916 | Forsyth . | |
| 1,872,740 | 8/1932 | James . | |
| 2,346,430 | 4/1944 | Hauser | 312/321.5 |
| 2,360,452 | 10/1944 | Stone . | |
| 2,441,721 | 5/1948 | Schroeder . | |
| 2,791,336 | 5/1957 | Stairwalt . | |
| 3,360,321 | 12/1967 | Novales . | |
| 3,643,607 | 2/1972 | MacKenzie . | |
| 3,648,626 | 3/1972 | Schuster . | |
| 3,760,744 | 9/1973 | Cruckshank | 108/102 X |
| 3,916,802 | 11/1975 | Virtue et al. . | |
| 4,084,703 | 4/1978 | Hossalla et al. | 108/137 X |
| 4,118,087 | 10/1978 | Dorf . | |
| 4,155,312 | 5/1979 | Thorkildson | 108/137 |
| 4,193,650 | 3/1980 | Gray et al. | 312/205 X |
| 4,283,099 | 8/1981 | Burton | 312/242 |
| 4,381,715 | 5/1983 | Forman | 108/137 X |
| 4,478,337 | 10/1984 | Flum | 211/153 |
| 4,500,146 | 2/1985 | Peterson | 108/102 |

FOREIGN PATENT DOCUMENTS

| | | |
|---|---|---|
| 178984 | 5/1922 | United Kingdom . |

*Primary Examiner*—Kenneth J. Dorner
*Assistant Examiner*—Rodney B. White
*Attorney, Agent, or Firm*—Burd Bartz & Gutenkauf

[57] ABSTRACT

A legless shelf assembly for use in a locker to provide support for articles to be stored in the locker. The shelf assembly has first and second shelf members movably relative to each other to expanded and retracted positions. Releasable cooperating rachet teeth on the side walls of the shelf members retain the shelf members in their expanded positions. An actuator cam rotatably mounted on one of the shelf members cooperates with teeth on the other of the shelf members to move the shelf members in opposite directions and further retain the shelf members in their expanded positions in tight engagement with the side walls of the locker.

64 Claims, 6 Drawing Sheets

LEGLESS LOCKER SHELF ASSEMBLY

FIELD OF INVENTION

The technical field of the invention is shelf structures used in storage lockers, including school lockers.

BACKGROUND OF THE INVENTION

Storage lockers are used in a number of environments such as industrial, commercial, military and educational institutions for temporary storage of personal items such as clothing, books, sporting equipment and the like. An example of a knock-down locker is shown by Novales in U.S. Pat. No. 3,360,321. This locker has a top shelf permanently attached to the locker side walls. The shelf has a fixed length and fits into a specific size locker. Boards and plywood panels have been used as auxiliary or additional locker shelves. The panels are made slightly wider than the width of the locker so that they can be wedged against the locker side walls to hold them in a selected vertical position. The wedging of the panels against the side walls distorts and bends the locker side walls and the door frame. In some cases, the door frame is warped so that the locker door cannot be closed. Lockers are normally located in side-by-side locations such as found in schools. When one locker is distorted, the adjacent locker is also distorted. This can cause the locker doors to jam shut or prevent the locker doors from closing. R. R. Peterson in U.S. Pat. No. 4,500,146 discloses a laterally adjustable locker shelf assembly having a plurality of locker shelves mounted on upright legs. Each locker shelf can be laterally expanded to position the locker shelf assembly within a locker. The locker shelf assembly of the invention is an expandable shelf assembly that does not utilize support legs to locate the shelf assembly within a locker.

SUMMARY OF THE INVENTION

The invention is directed to a legless locker shelf assembly that can be positioned within the locker at a selected location for accommodating articles, such as clothing, books, tools, sporting equipment and the like. The locker is a conventional locker used in schools, homes, sports clubs, industrial and office environments. The legless locker shelf assembly is an independent laterally adjustable shelf unit that fits into the locker and is forced against opposite locker side walls and retained therein with dual locking structure. The legless locker shelf assembly is a self contained unit as it does not require any assembly at the locker and is convenient and easy to install. Once the locker shelf assembly is expanded to its selected location, it is a strong, durable structure that can support considerable loads without the use of legs or support rods or connectors, such as bolts and screws, attaching the shelf to the locker walls.

One form of the shelf assembly has first and second shelf members having overlapping top walls and side walls that are movable relative to each other to change the longitudinal length of the shelf assembly. Adjacent side walls of the shelf members have engaging rachet teeth allowing opposite outward movements of the shelf members to expand the shelf assembly and prevent inward movements of the shelf members. The rachet teeth are releasable from each other by flexing the adjacent side walls in opposite directions to disengage the rachet teeth whereby the shelf members can be moved toward each other to contract the shelf assembly. Guides and supports on the shelf members maintain the shelf members in general longitudinal alignment and allow relative longitudinal alignment and allow relative longitudinal movement of shelf members. A plurality of longitudinally spaced cam follower teeth are attached to the top wall of the first shelf member. A cam actuator having a spiral-shaped outer edge is rotatably mounted on a boss attached to the second shelf member with the outer edge in engagement with at least one tooth. The outer edge has an inner portion and an outer portion located in overlapping relation and radially outward from the inner portion a distance substantially equal to the distance between adjacent teeth of the cam follower teeth so that the outer edge is in continuous engagement with at least one tooth upon rotation of the cam actuator to expand the shelf assembly and lock the shelf assembly in the expanded position. The boss is inclined at a small angle relative to the plane of the top wall of the second shelf member to tilt the cam actuator inwardly toward the cam follower teeth and maintain one portion of the outer edge in engagement with one tooth of the cam follower teeth.

Another form of the invention is an apparatus for expanding first and second members having cooperating structures for maintaining the members in general longitudinal alignment with each other and allowing relative longitudinal movements of the members. One of the members has longitudinal-spaced cam follower teeth that are engaged with a rotatable cam actuator. The cam actuator has a spiral-shaped outer edge engageable with at least one tooth of the cam follower teeth so that on rotation of the cam actuator, the members expand in opposite directions and are retained in their expanded positions. The outer edge has an inner portion and an outer portion located in overlapping relation and radially outward from the inner portion a distance substantially equal to the distance between adjacent teeth of the cam follower teeth so that the outer edge is in continuous engagement with at least one tooth of the cam follower teeth upon rotation of the cam actuator to expand the members and lock the members in the expanded position. The cam actuator is rotatably mounted on an inclined boss which tilts the cam actuator inwardly toward the cam follower teeth and maintains one portion of the outer edge in engagement with one tooth of the cam follower teeth.

DESCRIPTION OF PREFERRED EMBODIMENT

Figure 2:
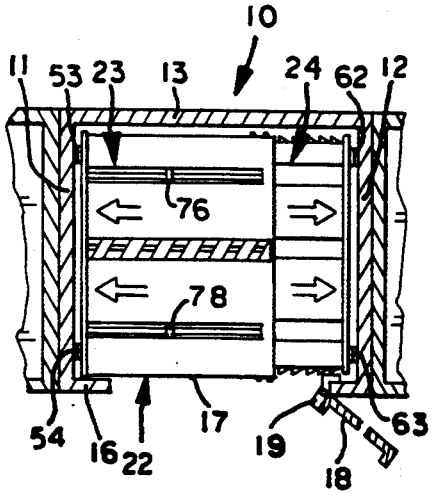
FIG. 2 is an enlarged sectional view taken along the line 2—2 of FIG. 1.
Figure 1:
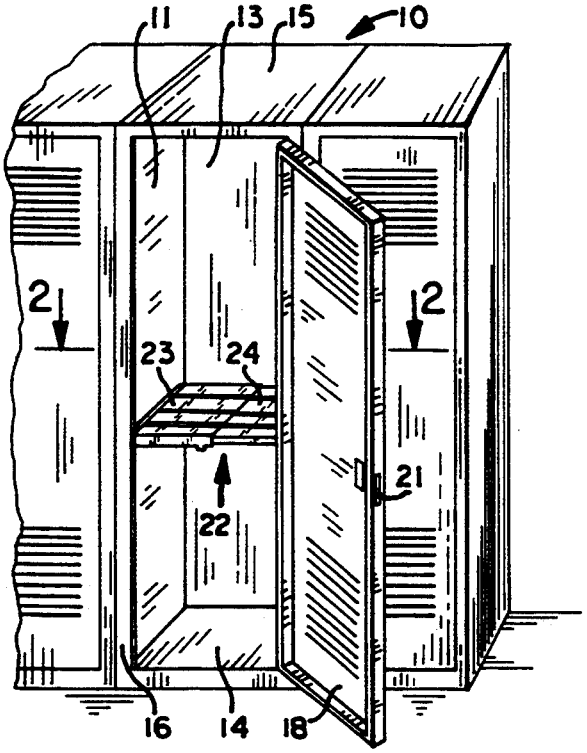
FIG. 1 is a perspective view of a group of lockers showing one of the lockers accommodating the legless locker shelf assembly of the invention.

Referring to FIGS. 1 and 2, there is shown a conventional locker indicated generally at 10, normally used by one or more persons for safe keeping clothing, books, tools, sporting goods and like articles. Locker 10 has upright side walls 11 and 12 joined to an upright back wall 13. The lower part of the locker 10 has a bottom or floor 14. The top of the locker is covered with a top wall 15. The front of the locker has a generally rectangular door frame 16 providing a doorway 17 into the interior of the locker. A generally rectangular door 16 is movably mounted on frame 16 with a plurality of hinges 19. A releasable lock or latch 21 on the door is used to retain the door in the closed position.

A legless locker shelf assembly of the invention, indicated generally at 22, is positioned within locker 10. Locker shelf assembly 22 has a pair of shelf members indicated generally at 23 and 24 that are laterally movable relative to each other so that locker shelf assembly 22 can be expanded into a tight holding position against the side walls 11 and 12, as seen in FIG. 2. Legs or other support structures are not used to hold locker shelf assembly 22 within locker 10.

Figure 3:
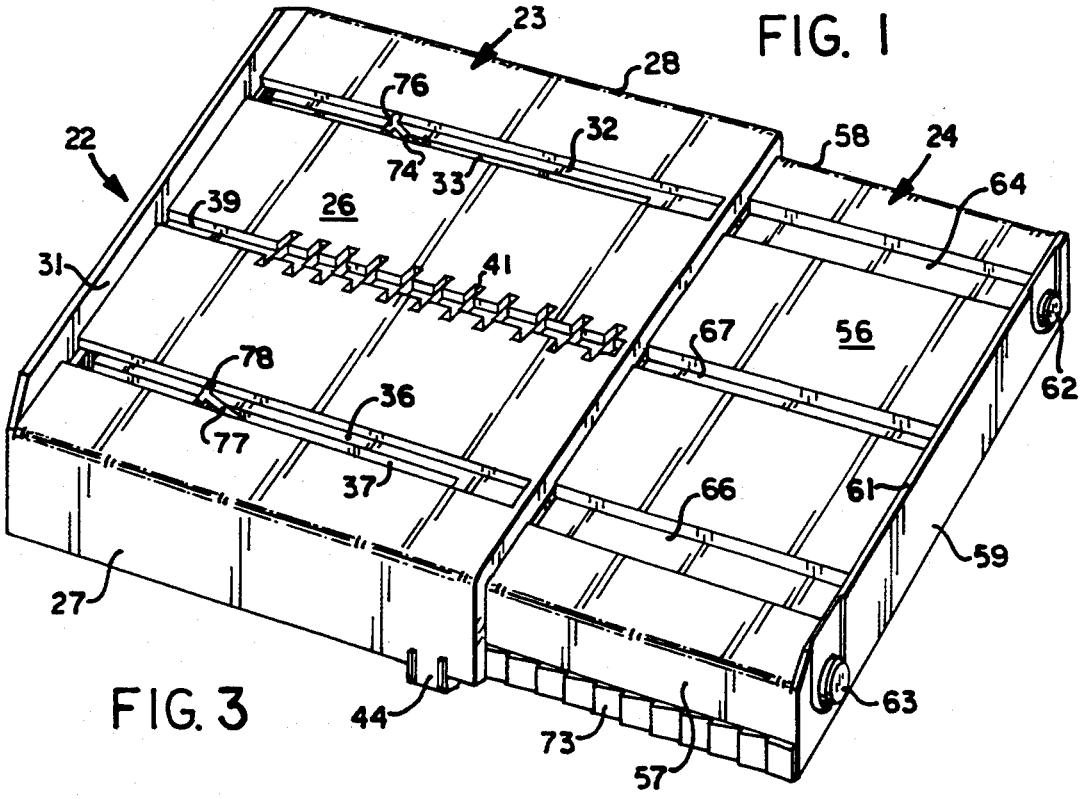
FIG. 3 is a perspective view of the legless locker shelf assembly shown in FIG. 1.
Figure 4:
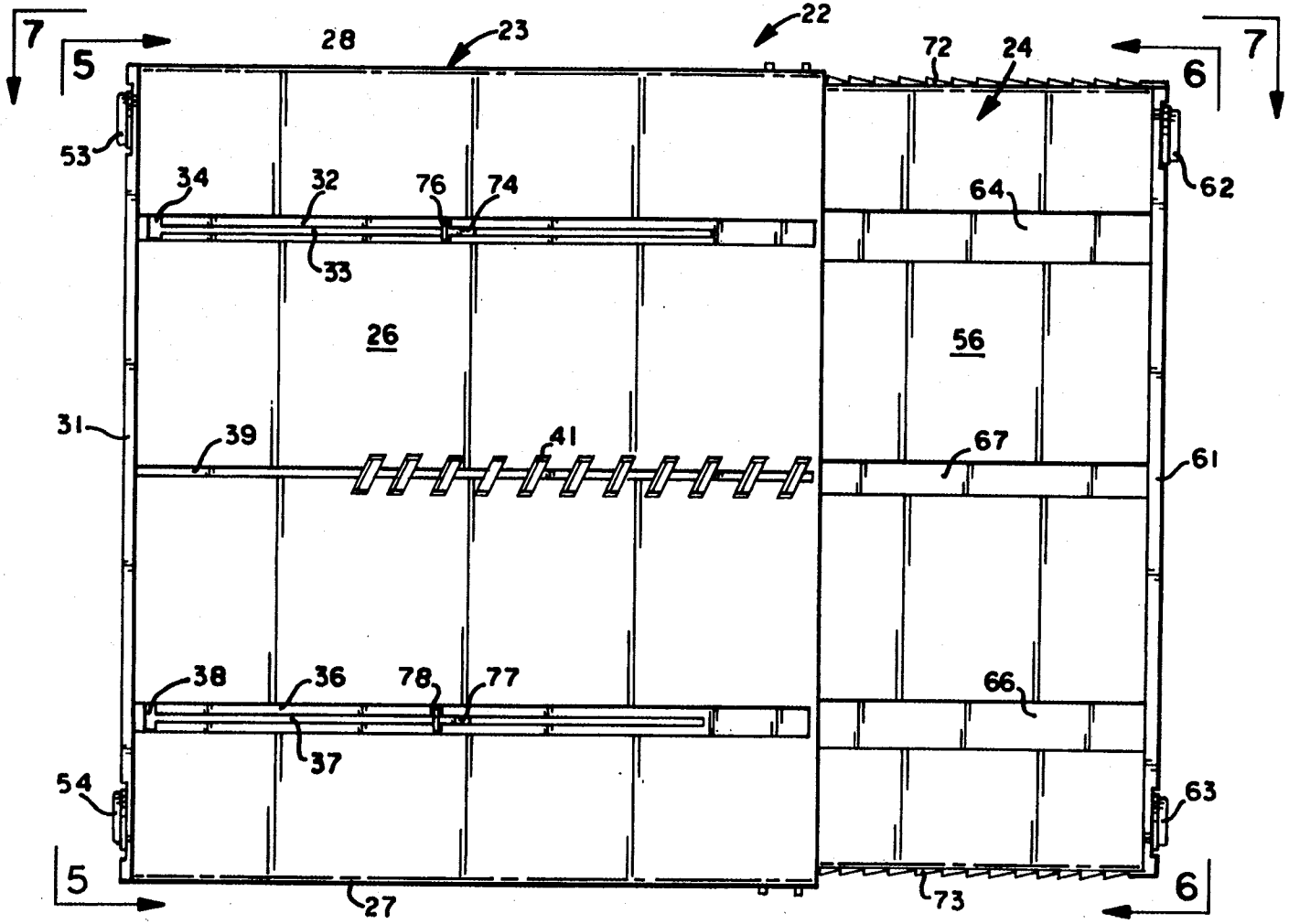
FIG. 4 is a top plan view of the legless locker shelf assembly of FIG. 3.
Figure 5:
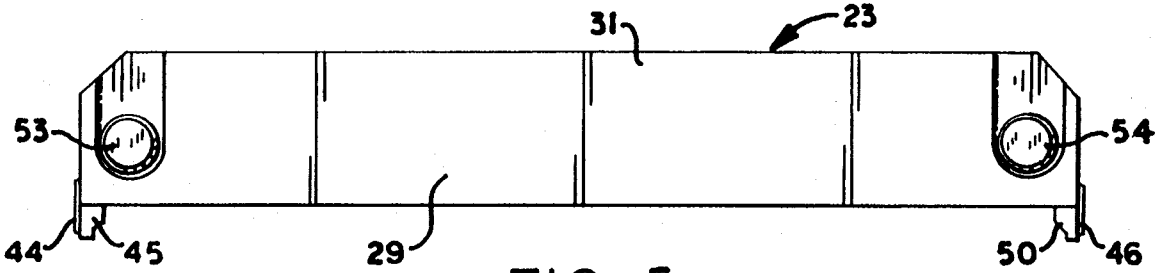
FIG. 5 is an end elevational view of the legless locker shelf assembly viewing along line 5—5 of FIG. 4.

As seen in FIGS. 3, 4 and 5, shelf member 23 has a generally flat top wall 26 joined to downwardly directed side walls 27 and 28 and a transverse outer end wall 29. The upper portion of end wall 29 has an upwardly directed transverse lip 31 to retain small articles on top wall 26. Top wall 26 has a pair of longitudinal grooves 32 and 36 having longitudinal slots 33 and 37, respectively extended between opposite ends of wall 26. As seen in FIG. 4, slot 33 has an outer end 34 which is transversely enlarged adjacent lip 31. A similar enlarged end 38 extends across slot 37 adjacent lip 31. The mid portion of wall 26 has a longitudinal slot 39 interrupted with a plurality of diagonal openings 41.

Figure 8:
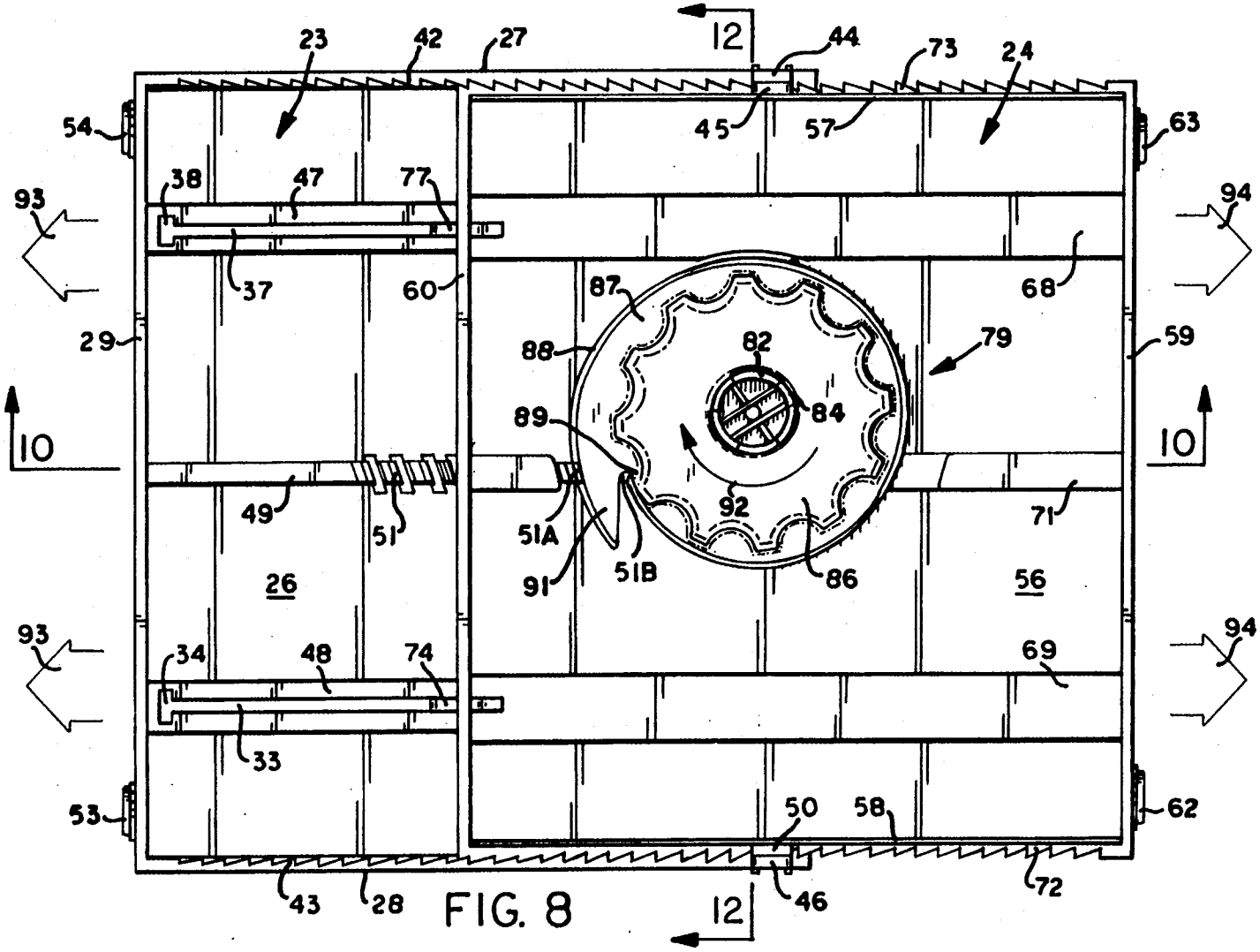
FIG. 8 is a bottom plan view of the legless locker shelf assembly showing the cam actuator in the position to expand the shelf assembly.
Figure 10:
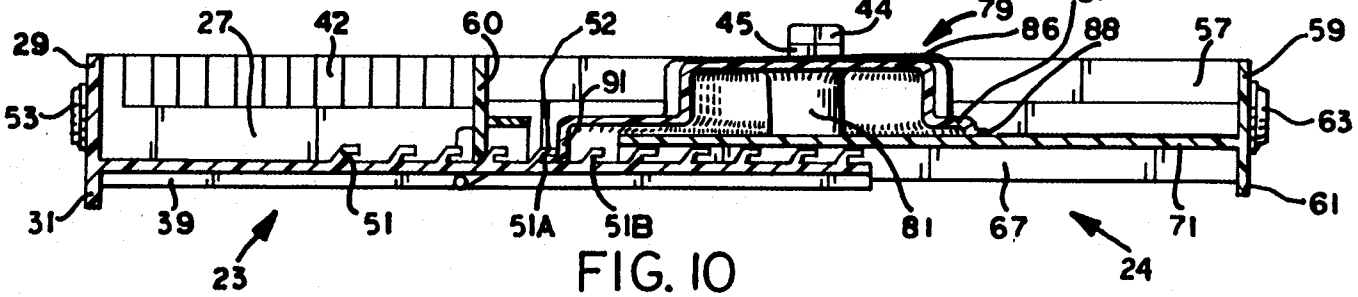
FIG. 10 is a sectional view taken along the line 10—10 of FIG. 8.
Figure 11:
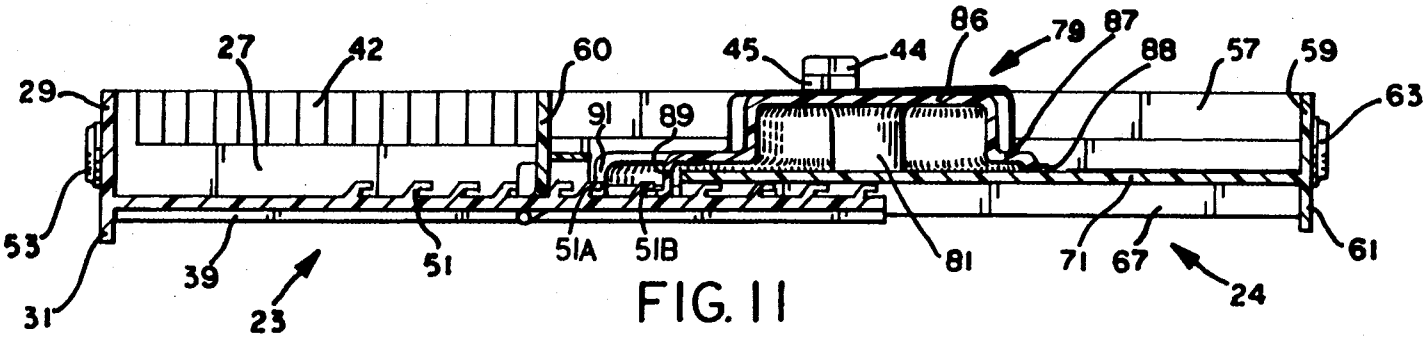
FIG. 11 is a sectional view taken along the line 11—11 of FIG. 9.

As seen in FIG. 8, side wall 27 has a plurality of longitudinally arranged teeth 42 that slope inwardly in a rearward direction. Side wall 28 has similar teeth 43 that are in transverse alignment with teeth 42 and slope inwardly in a rearward direction. The backs of teeth 42 and 43 slope inwardly and rearwardly away from end wall 29. The inner portions of side walls 27 and 28 have downwardly directed tabs 44 and 46. Tab 44 has an inwardly directed shoulder 45. Tab 46 has a similar inwardly directed shoulder 50. The functions of shoulders 45 and 50 are hereinafter described. The bottom of wall 26 has longitudinal side ribs 47 and 48 and a central longitudinal rib 49. Slot 37 extends longitudinally along rib 47. Slot 33 extends longitudinally along rib 48. Rib 49 is interrupted with a plurality of angularly longitudinally spaced teeth or cam followers 51. Each of teeth 51 are inclined at an angle of about 105 degrees relative to the longitudinal length of rib 49. Other angles of teeth 51 can be used. As shown in FIG. 10, each tooth 51 has an inwardly directed angular lip 52.

A pair of buttons 53 and 54 of rubber or plastic material are secured to opposite end portions of transverse wall 29. As seen in FIG. 2, buttons 53 and 54 are located in tight frictional engagement with side wall 11 when the shelf assembly is located within locker 10.

Returning to FIG. 3, shelf member 24 has a generally flat top wall 56 joined to downwardly directed longitudinal side walls 57 and 58. Side walls 57 and 58 are connected to an outside end wall 59 and an inside end wall 60. Outside end wall 59 has an upwardly directed lip 61 to retain small items on top wall 56. End wall 59 supports a pair of buttons 62 and 63 of plastic or rubber-like material adapted to be forced into tight frictional engagement with side wall 12, as seen in FIG. 2, when the shelf assembly is located within locker 10.

Figure 12:
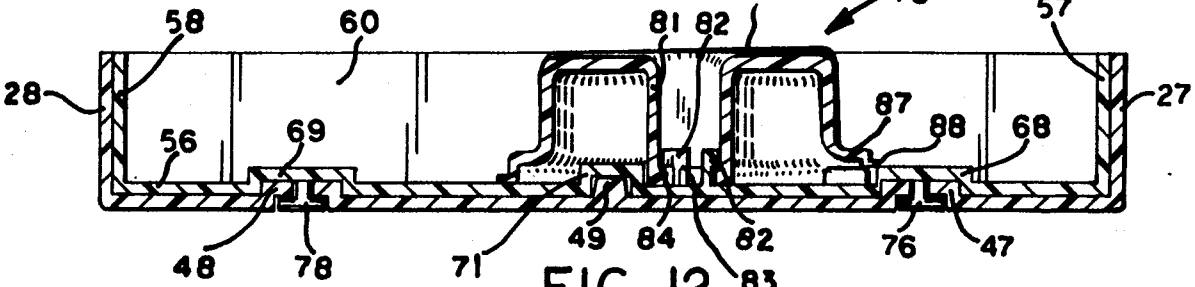
FIG. 12 is a sectional view taken along the line 12—12 of FIG. 8.

Returning to FIG. 4, top wall 56 has a pair of lateral longitudinal grooves 64 and 66 and a longitudinal center groove 67. Grooves 64 and 66 slideably accommodate ribs 47 and 48 to laterally guide shelf members 23 and 24 relative to each other. Center groove 67 accommodates rib 49. The structure that provides grooves 64, 66 and 67 are longitudinal ribs 68, 69 and 71, as seen in FIGS. 8 and 12.

Figure 6:
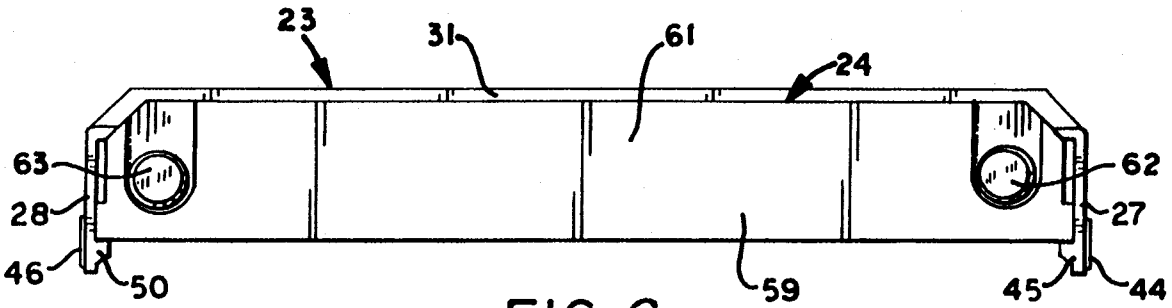
FIG. 6 is an end elevational view of the legless locker shelf assembly viewing along line 6—6 of FIG. 4.
Figure 7:
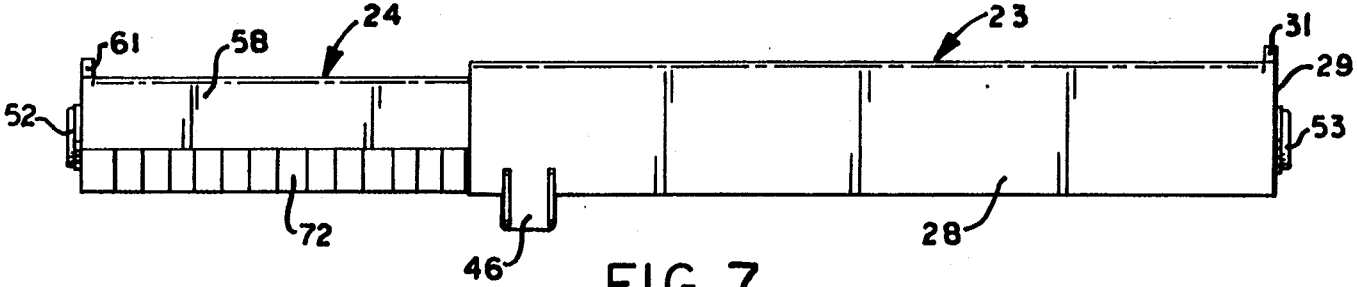
FIG. 7 is a side elevational view of the legless locker shelf assembly viewing along the line 7—7 of FIG. 4.

Side walls 57 and 58 of shelf member 24 have outwardly directed rachet teeth 72 and 73 which cooperate with the inwardly directed rachet teeth 42 and 43 of the side walls 27 and 28 of shelf member 23. Rachet teeth 72 and 73 slope inwardly in an outward direction toward end wall 59. As seen in FIG. 6, shoulders 45 and 50 are located below and in engagement with the lower edges of side walls 57 and 58 of shelf assembly 24 to provide supports for side walls 57 and 58 and retain rachet teeth 42, 73 and 43, 72 in engagement with each other.

Returning to FIGS. 3 and 4, a pair of necks 74 and 77 are secured to transverse wall 60 and extend through the slots 33 and 37. The outer ends of necks 74 and 77 have cross heads 76 and 78 located in grooves 32 and 36. When shelf members 23 and 24 are in their collapsed positions, cross heads 76 and 78 are located in alignment with the enlarged ends 34 and 38 at the outer ends of grooves 33 and 37. Cross heads 76 and 78 can move through openings 34 and 38 to allow shelf members 23 and 24 to be separated from each other and operatively connected to each other. No parts are removed from shelf members 23 and 24 to separate the shelf members or install the shelf assembly within locker 10.

Referring to FIGS. 8-12, there is shown a cam actuator indicated generally at 79 operable to expand shelf members 23 and 24 relative to each other and lock the shelf members in their expanded positions in tight holding engagement with side walls 11 and 12. Actuator 79 has a cylindrical hub 81 that surrounds a cylindrical boss 83 joined to wall 56 of shelf member 24. Boss 83 has upwardly directed flexible fingers 82 that extend over an outwardly directed annular rib 84 on hub 81 to retain the cam actuator in rotatable assembled relation with wall 56. Boss 83 extends downwardly and inwardly at a small angle of 5 degrees relative to the plane of wall 56 so that the actuator 79 is tilted in an inward direction toward transverse wall 60. Actuator 79 can be tilted at other angles. Actuator 79 has a downwardly directed knob 86 providing a convenient hand grip for the operator used to rotate the actuator. The lower portion of knob 86 has an outwardly directed flange 87 having a spiral outer edge 88. Edge 88 has an inner portion 89 that is overlapped with an outer portion 91 so that both the inner and outer portions 89 and 91 of edge 88 simultaneously engage teeth 51A and 51B. The overlap of edge portions 89 and 91 is about 10 degrees. The circumferential length of the edge is about 370 degrees. Other amounts of overlap can be used. The radial distance between end portion 89 and outer end portion 91 is substantially equal to the longitudinal distance between the adjacent teeth 51A and 51B.

Figure 9:
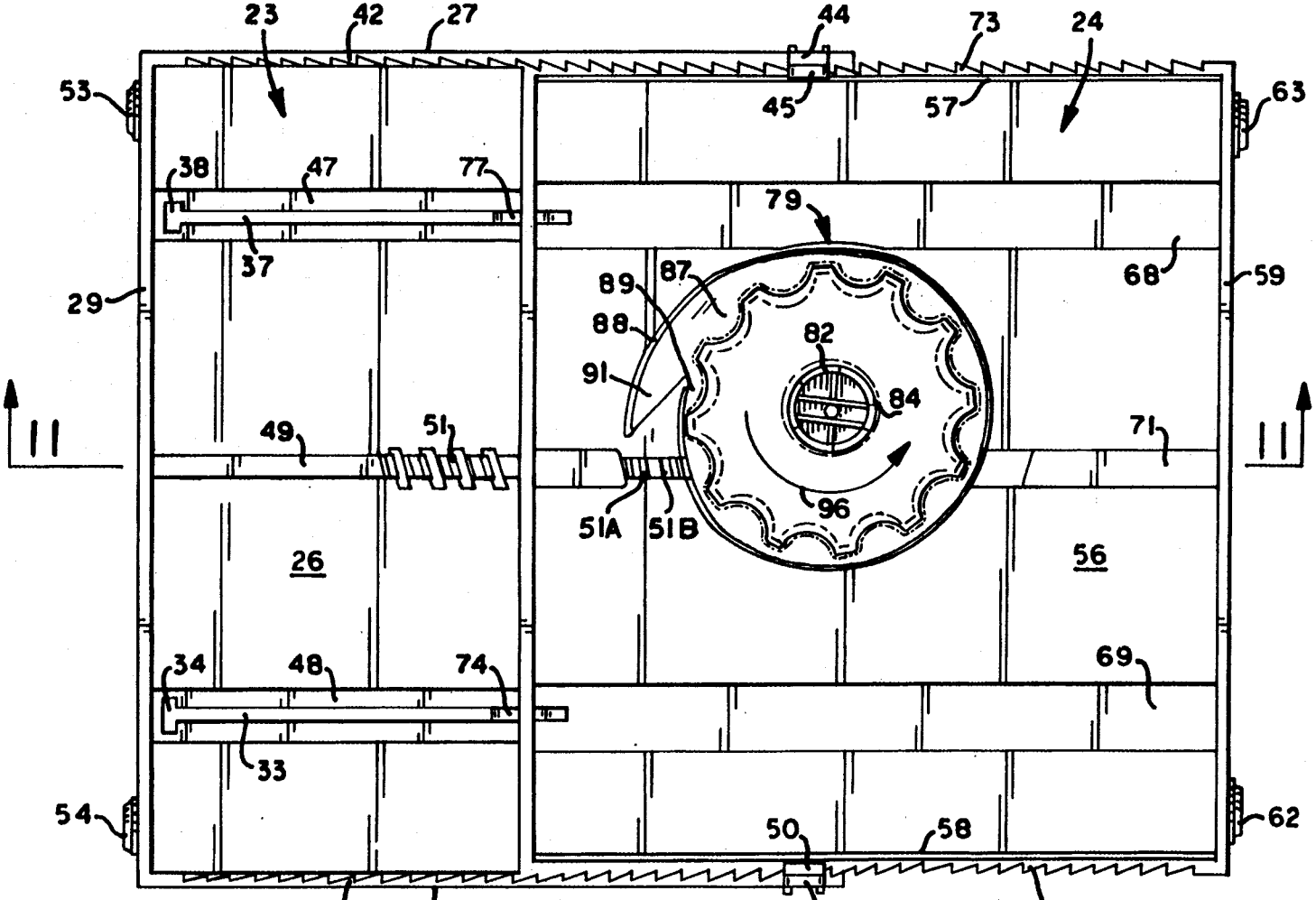
FIG. 9 is a bottom plan view of the legless locker shelf assembly showing the cam actuator in the position to allow the shelf assembly to contract.

In use, locker shelf assembly 22 is moved to its contracted position. As shown in FIG. 9, actuator 79 is moved in a counter clockwise direction, as indicated by arrow 96 to release edge 88 from teeth 51A and 51B. Tabs 44 and 46 are then forced outwardly to release the cooperating rachet teeth 42, 73 and 43, 72. Shelf members 23 and 24 can then be pivoted relative to each other to allow necks 74 and 77 to slide in grooves 33 and 37 to move cross heads 76 and 78 to end openings 34 and 38. Shelf members 23 and 24 are then moved to their generally longitudinal alignment to locate the rachet teeth 42, 73 and 43, 72 in rachet alignment and shoulders 45 and 50 under the lower edges of side walls 11 and 12 and end 58 thereby maintaining the longitudinal alignment of shelf members 23 and 24. Shelf assembly 22 is now in its contracted or small position.

The contracted locker shelf assembly 22 is placed in the locker chamber as shown in FIGS. 1 and 2. End walls 29 and 59 are located adjacent side walls 11 and 12 of the locker. Actuator 79 is then rotated in a clockwise direction, as indicated by arrow 92 in FIG. 8. Edge 88 engages a tooth 51A below lip 52 and moves the teeth and shelf members 23 and 24 in opposite outward directions. Actuator 79 is rotated a complete turn to advance shelf member 23 the distance between adjacent teeth. Edge portion 89 will pick up a tooth 51B before edge portion 91 moves away from a tooth 51A so that continuous rotation of actuator 79 in a clockwise direction will continuously move shelf members 23 and 24 in opposite outward directions. During the movement of shelf members 23 and 24 in opposite outward directions, the cooperating rachet teeth 42, 73 and 43, 72 will sequentially override cooperating teeth and prevent the contraction of shelf members 23 and 24 relative to each other. Actuator 79 is continuously rotated until the resilient buttons 53, 54 engage locker wall 11 and resilient buttons 62 and 63 engage locker wall 12. Buttons 53, 54, 62 and 63 are retained in tight compressed frictional engagement with walls 11 and 12 by continuing the rotation of actuator 79 in a clockwise direction, as indicated by arrow 92 in FIG. 8. Locker shelf assembly 22 is maintained in the expanded position by locking functions of the cooperating rachet teeth 42, 73 and 43, 72 and cam actuator 79 in engagement with a rachet tooth 51.

Legless locker shelf assembly 22 can be released from holding engagement with the locker side walls 11 and 12 by rotating actuator 79 in a counter clockwise direction, as indicated by arrow 96 to release edge 88 from it in engagement with tooth 51. Tabs 44 and 46 are then moved in an outward direction to release the interlocking rachet teeth 42, 73 and 43, 72 thereby allowing shelf members 23 and 24 to move toward each other to contract the shelf assembly. No assembly is required to install or remove the shelf assembly from a locker.

While there has been shown and described a preferred embodiment of the legless shelf assembly of the invention, it is understood that changes in the structure, arrangement of structure and materials can be made by those skilled in the art without departing from the invention. The invention is defined in the following claims.

We claim:

1. A shelf assembly for a locker having laterally spaced side walls comprising: a first shelf member having a top wall and downwardly directed first longitudinal side walls joined to the top wall, a second shelf member having a top wall and second downwardly directed side walls joined to the top wall, said side walls of the first and second shelf members having releasable cooperating holding means to retain the first and second shelf members in expanded positions, said first and second shelf members having means for maintaining the first and second shelf members in general longitudinal alignment, one of said first and second shelf members having a plurality of longitudinally spaced cam follower teeth, cam actuator means rotatably mounted on the other of said first and second shelf members, said cam actuator means being engageable with said cam follower teeth whereby on rotation of the cam actuator means, the first and second shelf members move in opposite directions into engagement with the side walls of the locker when the shelf assembly is located within the locker between the side walls thereof.

2. The shelf assembly of claim 1 wherein: the releasable cooperating holding means comprises first rachet teeth on said first side walls and second rachet teeth on said second side walls, said first and second rachet teeth being engageable with each other to allow outward movement of the shelf members to expand the shelf assembly and prevent inward movement of the shelf members to prevent contraction of the shelf assembly, said first and second rachet teeth being releasable from each other to allow inward movement of the shelf members and contraction of the shelf assembly.

3. The shelf assembly of claim 2 wherein: the first and second side walls have lower edges and the means for maintaining the first and second shelf members in general longitudinal alignment include shoulder means joined to the first side walls and engageable with the lower edges of the second side walls to provide supports for the second side walls.

4. The shelf assembly of claim 1 wherein: the means for maintaining the first and second shelf members in general longitudinal alignment include longitudinal slot means in the top wall of one of the shelf members and neck means on the other of the shelf members extended through said slot means and head means joined to the neck means engageable with the top wall of the one of the shelf members.

5. The shelf assembly of claim 1 wherein: the first and second side walls have lower edges, and the means for maintaining the first and second shelf members in generally longitudinal alignment include shoulder means joined to the first side walls and engageable with the lower edges of the second side walls to support the second side walls.

6. The shelf assembly of claim 1 wherein: the top wall of one of the shelf members has longitudinal groove means and the top wall of the other shelf member has ribbed means, said ribbed means extended into said groove means to allow relative longitudinal movement of said first and second shelf members.

7. The shelf assembly of claim 6 wherein: the means for maintaining the first and second shelf members in general longitudinal alignment include a longitudinal slot means located in said longitudinal groove means in the top wall of one of said shelf members and neck means on the other of the shelf members extended through said slot means and head means joined to the neck means engageable with the top wall of one of the shelf members.

8. The shelf assembly of claim 1 wherein: said cam actuator has a spiral-shaped outer edge having an inner portion and an outer portion, said outer portion overlapping said inner portion and located radially outward from said inner portion to maintain the outer edge in engagement with at least one tooth of the cam follower teeth.

9. The shelf assembly of claim 8 wherein: said outer portion is located a radial distance from the inner portion substantially equal to the distance between adjacent teeth of said cam follower teeth.

10. The shelf assembly of claim 1 including: means rotatably mounting the actuator means on the other of said shelf members for rotation about an axis inclined relative to the horizontal plane of said top wall of the other of said shelf members.

11. The shelf assembly of claim 10 wherein: said means rotatably mounting the actuator means on the second shelf member comprising a generally cylindrical boss and flexible fingers joined to the boss, said boss being attached to the second shelf member, said actuator means having a cylindrical hub and an outwardly directed flange joined to the hub, said hub located about said boss whereby the actuator means rotates about said boss, and said fingers cooperate with said flange to maintain said actuator means in assembled relation with said boss.

12. The shelf assembly of claim 11 wherein: said boss is inclined at an angle of about 5 degrees relative to the horizontal plane of the top wall of the second shelf member whereby said actuator is rotatable about the inclined axis of said boss.

13. The shelf assembly of claim 10 wherein: said means rotatably mounting the actuator means on the other of said shelf members comprising a generally cylindrical boss and flexible fingers joined to the boss, said boss being attached to the other of said shelf members, said actuator means having a cylindrical hub and an outwardly directed flange joined to the hub, said hub located about said boss whereby the actuator means rotates about said boss, and said fingers cooperate with said flange to maintain said actuator means in assembled relation with said boss.

14. The shelf assembly of claim 13 wherein: said boss is inclined at an angle of about 5 degrees relative to the horizontal plane of the top wall of the other of the shelf members whereby said actuator is rotatable about the inclined axis of said boss.

15. The shelf assembly of claim 1 wherein: said plurality of longitudinally spaced cam follower teeth are each inclined at an angle relative to the longitudinal length of the shelf assembly.

16. The shelf assembly of claim 1 wherein: one of said shelf members includes a longitudinal, generally central rib, said plurality of longitudinally spaced cam follower teeth intersecting said rib, other of said shelf members having a longitudinal groove accommodating said rib and teeth.

17. The shelf assembly of claim 1 wherein: said actuator means includes a knob providing a convenient hand grip for the operator for use in rotating the actuator means and an outwardly directed flange having a spiral outer edge engageable with said longitudinally spaced cam follower teeth whereby on rotation of the knob the edge in engagement with at least one of said teeth moves the first and second shelf members in opposite directions thereby expanding said shelf assembly.

18. The shelf assembly of claim 17 wherein: said actuator means includes a cylindrical hub joined to the knob, said hub having an outwardly directed annular flange, a cylindrical boss joined to the other of said shelf members, and a plurality of flexible fingers joined to said boss, said cylindrical hub being located about said boss whereby said knob rotates about the axis of said boss, said flexible fingers extended over the outwardly directed annular flange to retain the actuator means in rotatable assembled relation with said other of said shelf members.

19. The shelf assembly of claim 18 wherein: said boss is inwardly inclined and has a inwardly inclined axis, said actuator means being rotated about said inclined axis of the boss.

20. The shelf assembly of claim 17 wherein: each of the cam follower teeth have a forwardly projected lip on the outer end thereof, said outer edge of the actuator means movable under the lip of the tooth engaged by said outer edge.

21. A shelf assembly for a structure having laterally spaced walls comprising: a first shelf member having a top wall, side walls, one end wall and an open end, a second shelf member having a top wall and side walls locatable between said side walls of the first shelf member and below the top wall of said first shelf member, said second shelf member extended outwardly from the open end of the first shelf member, adjacent side walls of the first and second shelf members having engaging rachet teeth allowing opposite outward movements of the first and second shelf members to expand the shelf assembly and preventing inward movements of the first and second shelf members, said rachet teeth being releasable from each other to allow inward movement of the first and second shelf members to contract the shelf assembly, means attached to said first and second shelf members for maintaining the first and second shelf members in general longitudinal alignment with each other a plurality of longitudinal-spaced cam follower teeth attached to the top wall of the first shelf member, cam actuator means having a spiral-shaped outer portion engageable with at least one of said teeth so that on rotation of the cam actuator means, the first and second shelf assemblies move outwardly in opposite directions whereby when the shelf assembly is between said spaced walls, the shelf members move into engagement with said laterally spaced walls, and means attached to the top wall of the second shelf member rotatably supporting said cam actuator means.

22. The shelf assembly of claim 19 wherein: said plurality of longitudinally spaced cam follower teeth are each inclined at an angle relative to the longitudinal length of the shelf assembly.

23. The shelf assembly of claim 21 wherein: one of said shelf members includes a longitudinal, generally central rib, said plurality of longitudinally spaced cam follower teeth intersecting said rib, other of said shelf members having a longitudinal groove accommodating said rib and teeth.

24. The shelf assembly of claim 21 wherein: the first and second side walls have lower edges, and the means for maintaining the first and second shelf members in general longitudinal alignment include shoulder means joined to the first side walls and engageable with the lower edges of the second side walls to provide supports for the second side walls.

25. The shelf assembly of claim 24 wherein: the means for maintaining the first and second shelf members in general longitudinal alignment include longitudinal slot means in the top wall of one of the shelf members and neck means on the other of the shelf members extended through said slot means, and head means joined to the neck means engageable with the top wall of the one of the shelf members.

26. The shelf assembly of claim 25 wherein: the first and second side walls have lower edges, and the means for maintaining the first and second shelf members in generally longitudinal alignment include shoulder means joined to the first side walls and engageable with the lower edges of the second side walls to support the second side walls, said top wall of one of the shelf members has longitudinal groove means and the top wall of the other shelf member has ribbed means, said ribbed means extended into said groove means to allow relative longitudinal movement of said first and second shelf members.

27. The shelf assembly of claim 26 wherein: the means for maintaining the first and second shelf members in general longitudinal alignment include a longitudinal slot means located in said longitudinal groove means in the top wall of one of said shelf members and neck means on the other of the shelf members extended through said slot means and head means joined to the neck means engageable with the top wall of one of the shelf members.

28. The shelf assembly of claim 21 wherein: said cam actuator has a spiral-shaped outer edge having an inner portion and an outer portion, said outer portion overlapping said inner portion and located radially outward from said inner portion to maintain the outer edge in engagement with at least one tooth of the cam follower teeth.

29. The shelf assembly of claim 24 wherein: said outer portion is located a radial distance from the inner portion substantially equal to the distance between adjacent teeth of said cam follower teeth.

30. The shelf assembly of claim 1 wherein: the means rotatably supporting the actuator means on the second shelf member has an axis inclined relative to the horizontal plane of said top wall of the first shelf members whereby said actuator means rotates about said inclined axis.

31. The shelf assembly of claim 1 wherein: said actuator means includes a knob providing a convenient hand grip for the operator for use in rotating the actuator means and an outwardly directed flange having a spiral outer edge engageable with said longitudinally spaced cam follower teeth whereby on rotation of the knob the edge in engagement with at least one of said teeth moves the first and second shelf members in opposite directions thereby expanding said shelf assembly.

32. The shelf assembly of claim 31 wherein: said actuator means includes a cylindrical hub joined to the knob, said hub having an outwardly directed annular flange, a cylindrical boss joined to the other of said shelf members, and a plurality of flexible fingers joined to said boss, said cylindrical hub being located about said boss whereby said knob rotates about the axis of said boss, said flexible fingers extended over the outwardly directed annular flange to retain the actuator means in rotatable assembled relation with said other of said shelf members.

33. The shelf assembly of claim 32 wherein: said boss is inwardly inclined and has a inwardly inclined axis, said actuator means being rotated about said inclined axis of the boss.

34. A shelf assembly for a structure having laterally spaced walls comprising: a first shelf member having a top wall located adjacent said top wall of the first shelf members, means attached to said first and second shelf members for maintaining the first and second shelf members in general longitudinal alignment with each other and allowing relative longitudinal movement of said first and second shelf members, a plurality of longitudinal-spaced cam follower teeth attached to the top wall of one of the shelf members, cam actuator means having a spiral-shaped outer portion engageable with at least one of said teeth so that on rotation of the cam actuator means, the first and second shelf members move outwardly in opposite longitudinal directions whereby when the shelf assembly if between said spaced walls, the engagement with said laterally spaced walls, shelf members move into engagement with said laterally-spaced walls, and means attached to the top wall of the outer of said shelf members rotatably supporting said cam actuator means.

35. The shelf assembly of claim 34 wherein: the means for maintaining the first and second shelf members in general longitudinal alignment include longitudinal slot means in the top wall of one of the shelf members and neck means on the other of the shelf members extended through said slot means and head means joined to the neck means engageable with the top wall of the one of the shelf members.

36. The shelf assembly of claim 34 wherein: the first shelf member has first side walls, said second shelf member has second side walls, the first and second side walls have lower edges, and the means for maintaining the first and second shelf members in generally longitudinal alignment include shoulder means joined to the first side walls and engageable with the lower edges of the second side walls to support the second side walls.

37. The shelf assembly of claim 34 wherein: the top wall of one of the shelf members has longitudinal groove means and the top wall of the other shelf member has ribbed means, said ribbed means extended into said groove means to allow relative longitudinal movement of said first and second shelf members.

38. The shelf assembly of claim 37 wherein: the means for maintaining the first and second shelf members in general longitudinal alignment include a longitudinal slot means located in said longitudinal groove means in the top wall of one of said shelf members and neck means on the other of the shelf members extended through said slot means and head means joined to the neck means engageable with the top wall of one of the shelf members.

39. The shelf assembly of claim 34 wherein: said spiral-shaped outer edge portion of the cam actuator means has an inner portion and an outer portion, said outer portion overlapping said inner portion and located radially outward from said inner portion to maintain the outer edge in engagement with at least one tooth of the cam follower teeth.

40. The shelf assembly of claim 39 wherein: said outer portion is located a radial distance from the inner portion substantially equal to the distance between adjacent teeth of said cam follower teeth.

41. The shelf assembly of claim 34 wherein: the means rotatably mounting the actuator means on the other of said shelf members has an axis inclined relative to the horizontal plane of said top wall of the other of said shelf members.

42. The shelf assembly of claim 41 wherein: said means rotatably mounting the actuator means on the other of said shelf members comprising a generally cylindrical boss and flexible fingers joined to the boss, said boss being attached to the other of said shelf members, said actuator means having a cylindrical hub and an outwardly directed flange joined to the hub, said hub located about said boss whereby the actuator means rotates about said boss, and said fingers cooperate with said flange to maintain said actuator means in assembled relation with said boss.

43. The shelf assembly of claim 42 wherein: said boss is inclined at an angle of about 5 degrees relative to the horizontal plane of the top wall of the other of the shelf members whereby said actuator is rotatable about the inclined axis of said boss.

44. The shelf assembly of claim 34 wherein: said plurality of longitudinally spaced cam follower teeth are each inclined at an angle relative to the longitudinal length of the shelf assembly.

45. The shelf assembly of claim 34 wherein: one of said shelf members includes a longitudinal, generally central rib, said plurality of longitudinally spaced cam follower teeth intersecting said rib, other of said shelf members having a longitudinal groove accommodating said rib and teeth.

46. The shelf assembly of claim 34 wherein: said actuator means includes a knob providing a convenient hand grip for the operator for use in rotating the actuator means and an outwardly directed flange having said spiral-shaped outer edge portion engageable with said longitudinally spaced cam follower teeth whereby on rotation of the knob, the edge portion in engagement with at least one of said teeth moves the first and second shelf members in opposite directions thereby expanding said shelf assembly.

47. The shelf assembly of claim 46 wherein: said actuator means includes a cylindrical hub joined to the knob, said hub having an outwardly directed annular flange, a cylindrical boss joined to the other of said shelf members, and a plurality of flexible fingers joined to said boss, said cylindrical hub being located about said boss whereby said knob rotates about the axis of said boss, said flexible fingers extended over the outwardly directed annular flange to retain the actuator means in rotatable assembled relation with said other of said shelf members.

48. The shelf assembly of claim 47 wherein: said boss is inwardly inclined and has a inwardly inclined axis, said actuator means being rotated about said inclined axis of the boss.

49. An apparatus for expanding first and second members and holding the members in an expanded position comprising: a first member, a second member located adjacent the first member, means attached to said first and second members for maintaining the first and second members in general longitudinal alignment with each other and allowing relative longitudinal movement of said first and second members, a plurality of longitudinal-spaced cam follower teeth attached to one of the members, cam actuator means having an outer spiral-shaped outer portion engageable with at least one of said teeth so that on rotation of the cam actuator means, the first and second members move away from each other in opposite longitudinal directions, and means attached to the other of said members rotatably supporting said cam actuator means.

50. The shelf assembly of claim 49 wherein: the first and second members have lower edges, and the means for maintaining the first and second shelf members in general longitudinal alignment include shoulder means joined to the first member and engageable with the lower edges of the second member to provide supports for the second member.

51. The apparatus of claim 49 wherein: the means for maintaining the first and second members in general longitudinal alignment include longitudinal slot means in one of the members and neck means on the other of the members extended through said slot means and head means joined to the neck means engageable with the one of the members.

52. The apparatus of claim 49 wherein: each of the first and second members has a top wall, the top wall of one of the members has longitudinal groove means and the top wall of the other member has ribbed means, said ribbed means extended into said groove means to allow relative longitudinal movement of said first and second members.

53. The apparatus of claim 52 wherein: the means for maintaining the first and second members in general longitudinal alignment include a longitudinal slot means located in said longitudinal groove means in the top wall of one of said members and neck means on the other of the members extended through said slot means and head means joined to the neck means engageable with the top wall of one of the members.

54. The apparatus of claim 49 wherein: said spiral-shaped outer edge portion of the cam actuator means has an inner portion and an outer portion, said outer portion overlapping said inner portion and located radially outward from said inner portion.

55. The apparatus of claim 54 wherein: said outer portion is located a radial distance from the inner portion substantially equal to the distance between adjacent teeth of said cam follower teeth.

56. The apparatus of claim 54 including: means rotatably mounting the actuator means on the other of said members for rotation about an axis inclined relative to the horizontal plane of the other of said members.

57. The apparatus of claim 56 wherein: said means rotatably mounting the actuator means on the other of said members comprising a generally cylindrical boss and flexible fingers joined to the boss, said boss being attached to the other of said members, said actuator means having a cylindrical hub and an outwardly directed flange joined to the hub, said hub located about said boss whereby the actuator means rotates about said boss, and said fingers cooperate with said flange to maintain said actuator means in assembled relation with said boss.

58. The apparatus of claim 57 wherein: said boss is inclined at an angle of about 5 degrees relative to the horizontal plane of the other of the members whereby said actuator is rotatable about the inclined axis of said boss.

59. The apparatus of claim 49 wherein: said plurality of longitudinally spaced cam follower teeth are each inclined at an angle relative to the longitudinal length of the apparatus.

60. The apparatus of claim 49 wherein: one of said members includes a longitudinal, generally central rib, said plurality of longitudinally spaced cam follower teeth intersecting said rib, other of said members having a longitudinal groove accommodating said rib and teeth.

61. The apparatus of claim 49 wherein: said actuator means includes a knob providing a convenient hand grip for the operator for use in rotating the actuator means and an outwardly directed flange having said spiral outer edge portion engageable with said longitudinally spaced cam follower teeth whereby on rotation of the knob, the edge portion in engagement with at least one of said teeth moves the first and second members in opposite directions thereby expanding said apparatus.

62. The apparatus of claim 61 wherein: said actuator means includes a cylindrical hub joined to the knob, said hub having an outwardly directed annular flange, a cylindrical boss joined to the other of said members, and a plurality of flexible fingers joined to said boss, said cylindrical hub being located about said boss whereby said knob rotates about the axis of said boss, said flexible fingers extended over the outwardly directed annular flange to retain the actuator means in rotatable assembled relation with said other of said members.

63. The apparatus of claim 62 wherein: said boss is inwardly inclined and has a inwardly inclined axis, said actuator means being rotated about said inclined axis of the boss.

64. The apparatus of claim 49 wherein: each of the cam follower teeth have a forwardly projected lip on the outer end thereof, said outer edge portion of the actuator means movable under the lip of the tooth engaged by said outer edge portion.

* * * * *